US005872550A

United States Patent [19]

Quan et al.

[11] Patent Number: 5,872,550

[45] Date of Patent: Feb. 16, 1999

[54] COMPRESSIBLE COAXIAL INTERCONNECTION WITH INTEGRATED ENVIRONMENTAL SEAL

[75] Inventors: Clifton Quan, Arcadia; Mark Y. Hashimoto, Torrance; Rosie M. Jorgenson, Norwalk, all of Calif.

[73] Assignee: Raytheon Company, Lexington, Mass.

[21] Appl. No.: 871,036

[22] Filed: Jun. 9, 1997

[51] Int. Cl.[6] ..... H01Q 1/00; H01P 3/06

[52] U.S. Cl. ..... 343/905; 333/243

[58] Field of Search ..... 343/905; 333/243

[56] References Cited

U.S. PATENT DOCUMENTS 5,552,752 9/1996 Sturdivant et al. ..... 333/243

*Primary Examiner*—Frank G. Font
*Assistant Examiner*—Roy M. Punnoose
*Attorney, Agent, or Firm*—Leonard A. Alkov; Glenn H. Lenzen, Jr.

[57] ABSTRACT

A coaxial IF interconnect structure that is compressible in the z-axis and provides its own environmental seal against moisture and coolant. The structure (50) includes three components, a center conductor (60), dielectric spacer structure (70), and outer conductor shield (80), all fabricated of compressible materials. The center conductor is a compressible metal interconnection element formed by die compressing 1 mil diameter fine wire to a desired shape and density. The coaxial dielectric structure supports the compressible center conductor, and is fabricated from a fluorinated elastomer (FM) known as fluorosilicone. The compressible coaxial outer conductor shield functions as an IF gasket in the form of an round flat washer surrounding the dielectric structure and center conductor.

14 Claims, 2 Drawing Sheets

COMPRESSIBLE COAXIAL INTERCONNECTION WITH INTEGRATED ENVIRONMENTAL SEAL

TECHNICAL FIELD OF THE INVENTION

This invention relates to microwave interconnection devices, and more particularly to a compressible coaxial interconnection device with an integrated environmental seal.

BACKGROUND OF THE INVENTION

Electrically interconnecting circuit boards has conventionally been accomplished with cables or ribbons. The disadvantage to these methods are size, weight, and cost. Other transmission interconnections require a more permanent attachment, such as solders and epoxies, and have relatively narrow operating bandwidths. Removable IF interconnects typically require considerable depth and additional elements, and add weight. Moreover, separate materials and processes are conventionally required to environmentally protect these conventional interconnect devices before or after they are installed in a microwave assembly.

SUMMARY OF THE INVENTION

A coaxial IF interconnect structure is described that is compressible along its longitudinal axis, and provides an environmental seal. The structure includes a compressible, electrically conductive center conductor member, and a compressible dielectric member surrounding the center conductor member. A compressible coaxial outer IF conductor shield surrounds the dielectric member and center conductor member. Thus, all elements of the structure are compressible along the longitudinal axis.

This invention offers a new, compact approach to microwave packaging. Separate, individual hybrids can now be packaged vertically, saving valuable real estate. Other vertical bends require several process steps and a more permanent attachment such as epoxies and solders. The interconnect is completely shielded for electromagnetic interference (EMI) and coolant with little or no leakage.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
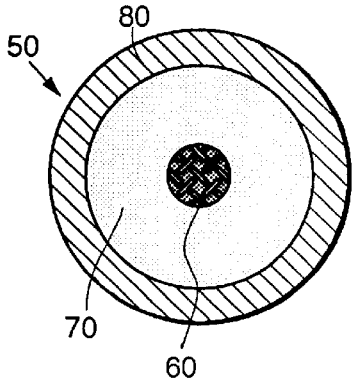
FIG. 1 is an end view of a compressible interconnect structure in accordance with the invention.
Figure 2:
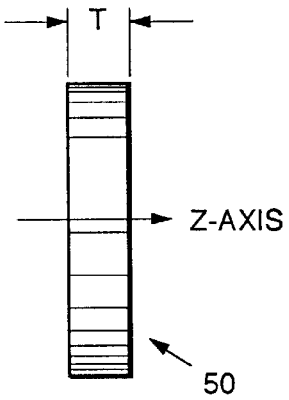
FIG. 2 is a side view of the structure 50.

The invention is a coaxial IF interconnect structure that is compressible in the z-axis and provides its own environmental seal against moisture and coolant. An IF interconnection structure 50 in accordance with the invention is illustrated in FIGS. 1 and 2, and includes three components. The center conductor 60, dielectric spacer structure 70, and outer conductor shield 80 are fabricated of compressible materials.

The first component is the center conductor 60 which is a compressible metal interconnection element formed by die compressing 1 mil diameter fine wire to a desired shape and density. The resulting interconnection element provides a coaxial center conductor contact that has low resistance, good redundancy of contact and mechanical compliance.

The second component of the interconnection structure 50 is the coaxial dielectric structure 70 supporting the compressible center conductor 60. This compressible dielectric structure in this exemplary embodiment is fabricated from a fluorinated elastomer (FM) known as fluorosilicone. This material is typically used as compressible environmental seals and O-ring gaskets to seal joints within various heat exchanger assemblies for automotive, aerospace and industrial applications. The material resists degradation from exposure to a wide range of fluids, including hot oils, gasoline, jet fuels and coolants. Fluorosilicone remains effective over a broad range of temperatures up to 600 deg. F. As an electrical insulator, fluorosilicone has good low frequency characteristic and is comparable to silicone in terms of thermal stability and aging.

The third component 80 of the interconnection structure is the compressible coax outer conductor shield which functions as an IF gasket in the form of an round flat washer surrounding the fluorosilicone dielectric structure 70 and center conductor 60. Typical IF gasket material uses either an silver or copper filled elastomer, typically silicone rubber or fluorosilicone.

FIG. 2 is a side view of the structure 50. In exemplary implementations, the interconnection structure 50 can have a thickness dimension T, measured along the Z axis, in the range of 0.030 inch to 0.060 inch. The center conductor 60 can have a diameter of 0.018 inch, and the dielectric structure 70 a diameter of 0.140 inches.

Figure 3:
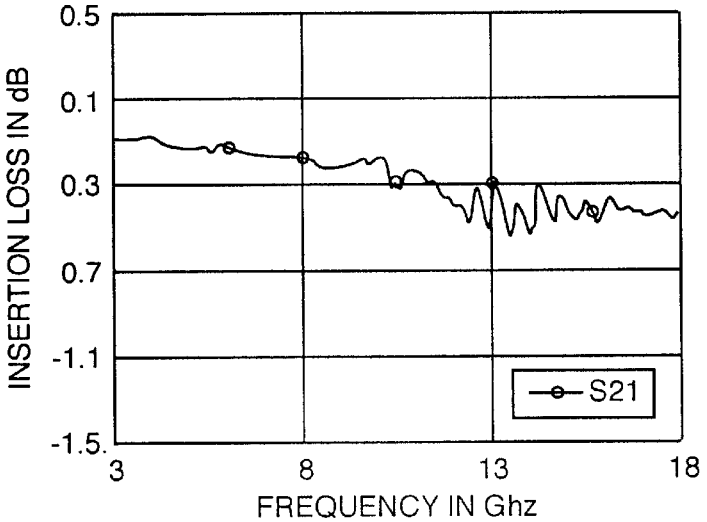
FIG. 3 is a graph illustrating insertion loss data as a function of frequency for an exemplary interconnect structure in accordance with the invention.
Figure 4:
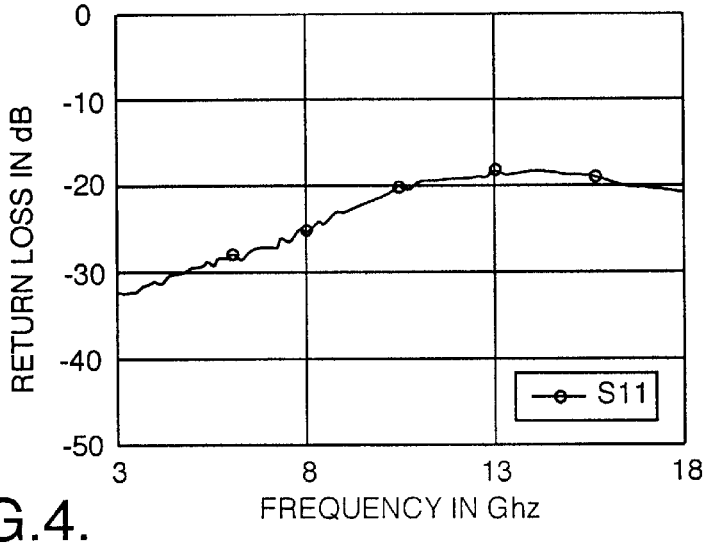
FIG. 4 is a graph of the return loss as a function of frequency for the interconnect structure as in FIG. 3.

FIG. 3 is a graph illustrating insertion loss data as a function of frequency for an exemplary interconnect structure in accordance with the invention, with a thickness of 0.030 inch and utilized with SAM connectors. FIG. 4 is a graph of the return loss as a function of frequency for the same device. The interconnection structure has good IF performance.

The combination of the three components 60, 70 and 80 forms a coaxial interconnection structure 50 with good IF performance, and will allow up to 10 mil tolerance in the z-axis under compression. IF losses as low as 0.2 dB is achievable up to 12 GHz with an interconnection structure in accordance with the invention. Since the connection is made under compression, this interconnect will provide its own environmental seal while maintaining the same good IF performance.

Figure 5:
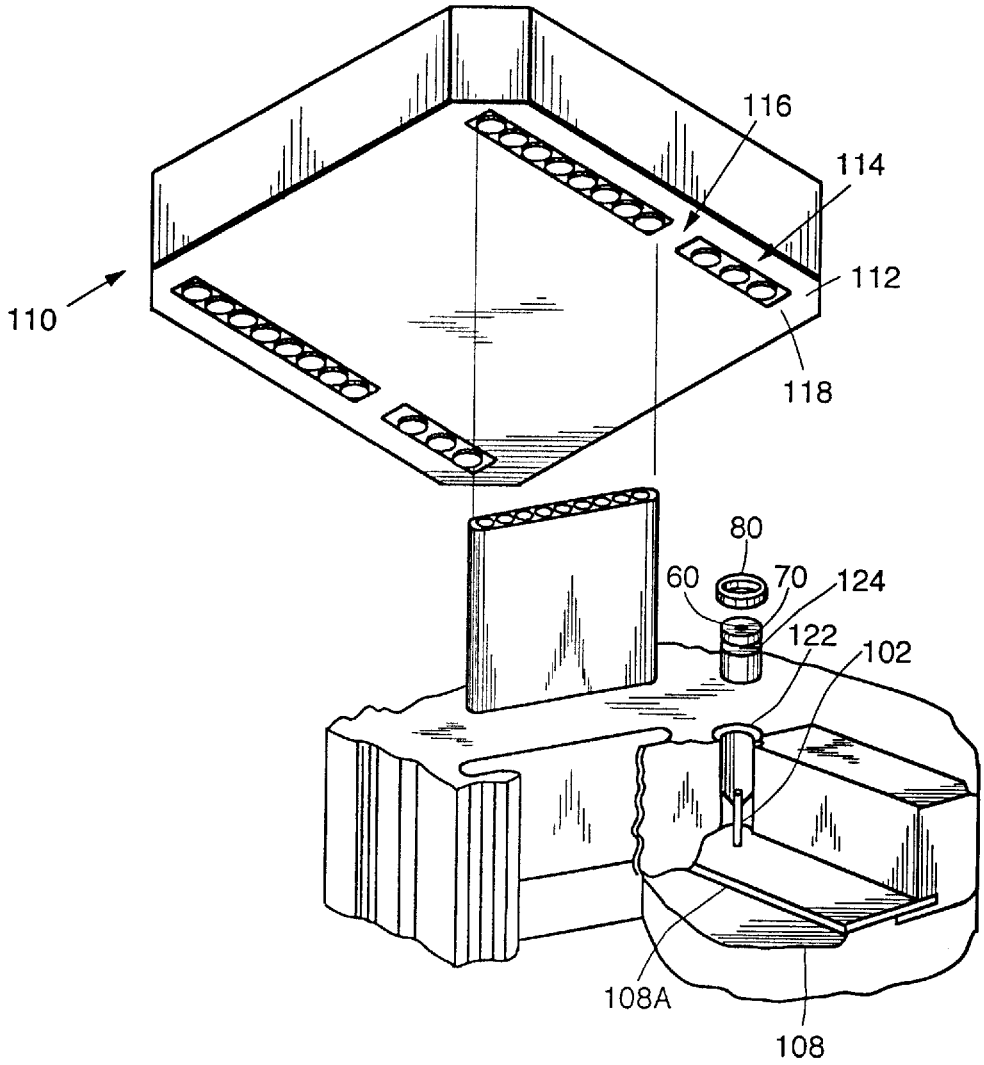
FIG. 5 is an exploded view showing elements of an array antenna system embodying the interconnect structure of this invention.

An exemplary application for this invention is to provide a vertical IF interconnect between the T/R modules and planar IF feed assembly for an active array antenna as shown in FIG. 5. To reduce the risk of the compressible center conductor smearing across the face of the coaxial interconnect and potentially short circuiting the transmission line during installation, the invention is configured so that the end of the compressible center conductor 60 is recessed below the face of the fluorosilicone dielectric 70. A solder ball or pin 114 protruding from the exposed dielectric 116 of the T/R module I/O ports 118 and the pin 102 attached to the IF feed I/O port 108 are then respectively inserted into the dielectric 70 to DC contact the compressible center conductor 60 while holding it in place by compression. A dielectric spacer 124 fits below the compressible interconnect. The outer shield 80 of the coaxial interconnect is in DC contact with the corresponding outer shields 112, 122 of the T/R module 110 and the IF feed 108 located on the surface of their housing packages. In this example, the IF feed is a strip line transmission line carried within a cold plate shown as housing 122. Finally the exposed dielectric 116 separating the pinned I/O ports and outer shield 112 of the T/R module and the dielectric substrate 108A of the IF feed will contact the fluorosilicone dielectric 70 at opposite ends of the interconnect structure.

The interconnection structure 50 can operate from DC to greater than 18 GHz with reasonable loss and good match. The interconnection structure can be employed to interconnect stacked multi-layer microwave hybrid assemblies by solder less vertical interconnects with self-sealing capability against moisture and coolant. Because of the solder less nature of the interconnection provided by the invention, stacked microwave hybrid printed wiring assemblies can be realized which are easy to assemble and disassemble for rework. Exemplary applications include vertical interconnects between stacked microwave substrates, which can be found in radar receiver/exciter assemblies, communication subsystems, and other microwave circuitry, found in radar systems, satellites, microwave automotive electronics, missile systems and other systems where size is important, such as cellular telephones.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A coaxial IF interconnect structure that is compressible along its longitudinal axis, and provides an environmental seal, comprising:

a compressible, electrically conductive center conductor member;

a compressible dielectric member surrounding the center conductor member; and a compressible coaxial outer IF conductor shield surrounding the dielectric member and center conductor member.

2. The interconnect structure of claim 1 wherein said compressible center conductor member comprises a mass of compressed fine metal wire.

3. The interconnect structure of claim 1 wherein said compressible dielectric member is fabricated of a dielectric elastomer material.

4. The interconnect structure of claim 1 wherein said dielectric elastomer material is fluorosilicone.

5. The interconnect structure of claim 1 wherein said outer shield comprises a metal filled elastomer.

6. The interconnect structure of claim 5 wherein said metal filled elastomer comprises silicone rubber filled with silver or copper.

7. The interconnect structure of claim 5 wherein said metal filled elastomer comprises fluorosilicone.

8. An active array antenna comprising:

a transmit/receive (T/R) module including an input/output (I/O) port;

an IF feed assembly including an IF feed port;

a vertical IF interconnect structure for providing an IF connection between said I/O port of said T/R module and said IF feed port of said IF feed assembly, comprising:

a compressible, electrically conductive center conductor member to provide IF contact between a conductor of said I/O port and a conductor of said IF feed port;

a compressible dielectric member surrounding the center conductor member; and a compressible coaxial outer IF conductor shield surrounding the dielectric member and center conductor member, said IF conductor shield making electrical contact with an outer shield of said T/R module and with an outer shield of said IF feed assembly.

9. The interconnect structure of claim 8 wherein said compressible center conductor member comprises a mass of compressed fine metal wire.

10. The interconnect structure of claim 8 wherein said compressible dielectric member is fabricated of a dielectric elastomer material.

11. The interconnect structure of claim 8 wherein said dielectric elastomer material is fluorosilicone.

12. The interconnect structure of claim 8 wherein said outer shield comprises a metal filled elastomer.

13. The interconnect structure of claim 12 wherein said metal filled elastomer comprises silicone rubber filled with silver or copper.

14. The interconnect structure of claim 12 wherein said metal filled elastomer comprises fluorosilicone.

* * * * *